US011959357B2

(12) United States Patent
Egbe et al.

(10) Patent No.: US 11,959,357 B2
(45) Date of Patent: Apr. 16, 2024

(54) CEMENTING ACROSS LOSS CIRCULATION ZONES UTILIZING A SMART DRILLABLE CEMENT STINGER

(71) Applicant: Saudi Arabian Oil Company, Dhahran (SA)

(72) Inventors: Peter Ido Egbe, Abqaiq (SA); Victor Jose Bustamante Rodriguez, Abqaiq (SA)

(73) Assignee: Saudi Arabian Oil Company, Dhahran (SA)

( * ) Notice: Subject to any disclaimer, the term of this patent is extended or adjusted under 35 U.S.C. 154(b) by 41 days.

(21) Appl. No.: 17/941,747

(22) Filed: Sep. 9, 2022

(65) Prior Publication Data

US 2023/0015016 A1 Jan. 19, 2023

Related U.S. Application Data

(62) Division of application No. 16/924,963, filed on Jul. 9, 2020, now Pat. No. 11,473,397.

(51) Int. Cl.

| | |
|---|---|
| ***E21B 33/138*** | (2006.01) |
| ***E21B 21/00*** | (2006.01) |
| ***E21B 33/127*** | (2006.01) |
| ***E21B 34/14*** | (2006.01) |

(52) U.S. Cl.

CPC ..... *E21B 33/138* (2013.01); *E21B 21/003* (2013.01); *E21B 33/127* (2013.01); *E21B 34/142* (2020.05)

(58) Field of Classification Search

CPC ..... E21B 33/13; E21B 7/061; E21B 33/127; E21B 33/14; E21B 33/1208; E21B 43/10

See application file for complete search history.

(56) References Cited

U.S. PATENT DOCUMENTS

| | | | |
|---|---|---|---|
| 2,014,563 | A | 9/1935 | Halliburton |
| 2,058,688 | A | 10/1936 | Halliburton |
| 2,801,715 | A | 8/1957 | Hall |

(Continued)

FOREIGN PATENT DOCUMENTS

| | | |
|---|---|---|
| CA | 2541318 | 9/2007 |
| WO | WO 2007092083 | 8/2007 |

(Continued)

OTHER PUBLICATIONS

PCT International Search Report and Written Opinion in International Appln. No. PCT/2021/040910, dated Sep. 29, 2021, 14 pages.

*Primary Examiner* — Zakiya W Bates

(74) *Attorney, Agent, or Firm* — Fish & Richardson P.C.

(57) ABSTRACT

Systems and methods include a computer-implemented method for handling loss circulation zones in wells. A tool is deployed on a work string. The tool includes isolation packers in an un-inflated state and a stinger in a closed position. The tool is run to a target depth along the work string. The isolation packers are inflated, setting the isolation packers in place adjacent to the stinger at the target depth. Circulation ports are opened after the isolation packers are inflated, exposing a diversion flow path. A cement slurry is pumped through the diversion flow path into a loss circulation zone. The circulation ports are closed after the cement slurry is pumped. The work string is disengaged from the stinger.

13 Claims, 6 Drawing Sheets

(56) References Cited

U.S. PATENT DOCUMENTS

| | | | | |
|---|---|---|---|---|
| 4,441,556 | A | 4/1984 | Powers et al. | |
| 5,314,015 | A | 5/1994 | Streich et al. | |
| 6,041,860 | A * | 3/2000 | Nazzal | E21B 33/127 73/152.01 |
| 6,269,878 | B1 | 8/2001 | Wyatt et al. | |
| 6,578,638 | B2 | 6/2003 | Guillory et al. | |
| 7,717,179 | B2 | 5/2010 | Rayssiguier et al. | |
| 2004/0040707 | A1 * | 3/2004 | Dusterhoft | E21B 33/124 166/279 |
| 2007/0261850 | A1 | 11/2007 | Giroux et al. | |
| 2009/0183875 | A1 | 7/2009 | Rayssiguier et al. | |
| 2011/0162844 | A1 | 7/2011 | Mauth | |
| 2020/0056446 | A1 | 2/2020 | Al-Mousa et al. | |

FOREIGN PATENT DOCUMENTS

| | | |
|---|---|---|
| WO | WO 2011130350 | 10/2011 |
| WO | WO 2017204784 | 11/2017 |

* cited by examiner

CEMENTING ACROSS LOSS CIRCULATION ZONES UTILIZING A SMART DRILLABLE CEMENT STINGER

CROSS REFERENCE TO RELATED APPLICATION

This application is a divisional of and claims priority to U.S. patent application Ser. No. 16/924,963, filed on Jul. 9, 2020, the entire contents of which is incorporated by reference herein.

BACKGROUND

The present disclosure applies to handling loss circulation zones in wells.

During the drilling or completion of a well, lost circulation can occur, for example, when a total or partial loss of drilling fluids is lost to high-permeability zones. The zones can include cavernous formations, natural fractures, or induced fractures created during drilling. Conventional drilling operations are typically unable to simultaneously isolate loss circulation zones from above and below, expose circulation ports for cement slurry displacement, and disengage the work string after completion of displacement operations. Drilling operations also typically do not provide a safety mechanism to mitigate for potential cement flash setting.

SUMMARY

The present disclosure describes techniques that can be used for cementing across loss circulation zones using a smart drillable cement stinger. In some implementations, a computer-implemented method includes the following. A tool is deployed on a work string. The tool includes isolation packers in an un-inflated state and a stinger in a closed position. The tool is run to a target depth along the work string. The isolation packers are inflated, setting the isolation packers in place adjacent to the stinger at the target depth. Circulation ports are opened after the isolation packers are inflated, exposing a diversion flow path. A cement slurry is pumped through the diversion flow path into a loss circulation zone. The circulation ports are closed after the cement slurry is pumped. The work string is disengaged from the stinger.

The previously described implementation is implementable using a computer-implemented method; a non-transitory, computer-readable medium storing computer-readable instructions to perform the computer-implemented method; and a computer-implemented system including a computer memory interoperably coupled with a hardware processor configured to perform the computer-implemented method/the instructions stored on the non-transitory, computer-readable medium.

The subject matter described in this specification can be implemented in particular implementations, so as to realize one or more of the following advantages. First, a cement plug can be placed across a loss circulation zone (LCZ) in a controlled and optimized manner without the effect of the hydrostatic head above the losses zone. For example, the optimized manner can refer to placement of the cement plug that results in hydrostatic head losses remaining within a predefined range. Second, a drillable cement stinger can be provided as a safety mechanism in case the stinger becomes cemented in place while trying to cure the losses with the cement plug. Third, the process for pumping cement plugs can be optimized to cure total losses scenarios. Fourth, packers on the cementing stinger can be activated through the use of radio frequency identification device (RFID) tags or activation ball systems. Fifth, improved cement volume control can be provided to cure/reduce mud losses. Sixth, losses can be reduced through the pumping of a losses cement plug with the drillable cementing stinger. Seventh, the hydrostatic head above the loss zone or the cement plug can be minimized or removed through the use of packers in the cement stinger. Eighth, cement placement operations can be improved in order to increase the likelihood of success in curing LCZs. Ninth, the risks associated with hole problems can be mitigated while running in hole (RIH), or pulling of the hole (POOH) with the cement stinger. Tenth, in addition to targeting loss circulation scenarios, an alternate solution is provided to set cement plugs for wellbore isolation, plug & abandon (P&A), and kick-off plugs for sidetrack.

The details of one or more implementations of the subject matter of this specification are set forth in the Detailed Description, the accompanying drawings, and the claims. Other features, aspects, and advantages of the subject matter will become apparent from the Detailed Description, the claims, and the accompanying drawings.

DESCRIPTION OF DRAWINGS

Like reference numbers and designations in the various drawings indicate like elements.

DETAILED DESCRIPTION

Figure 1:
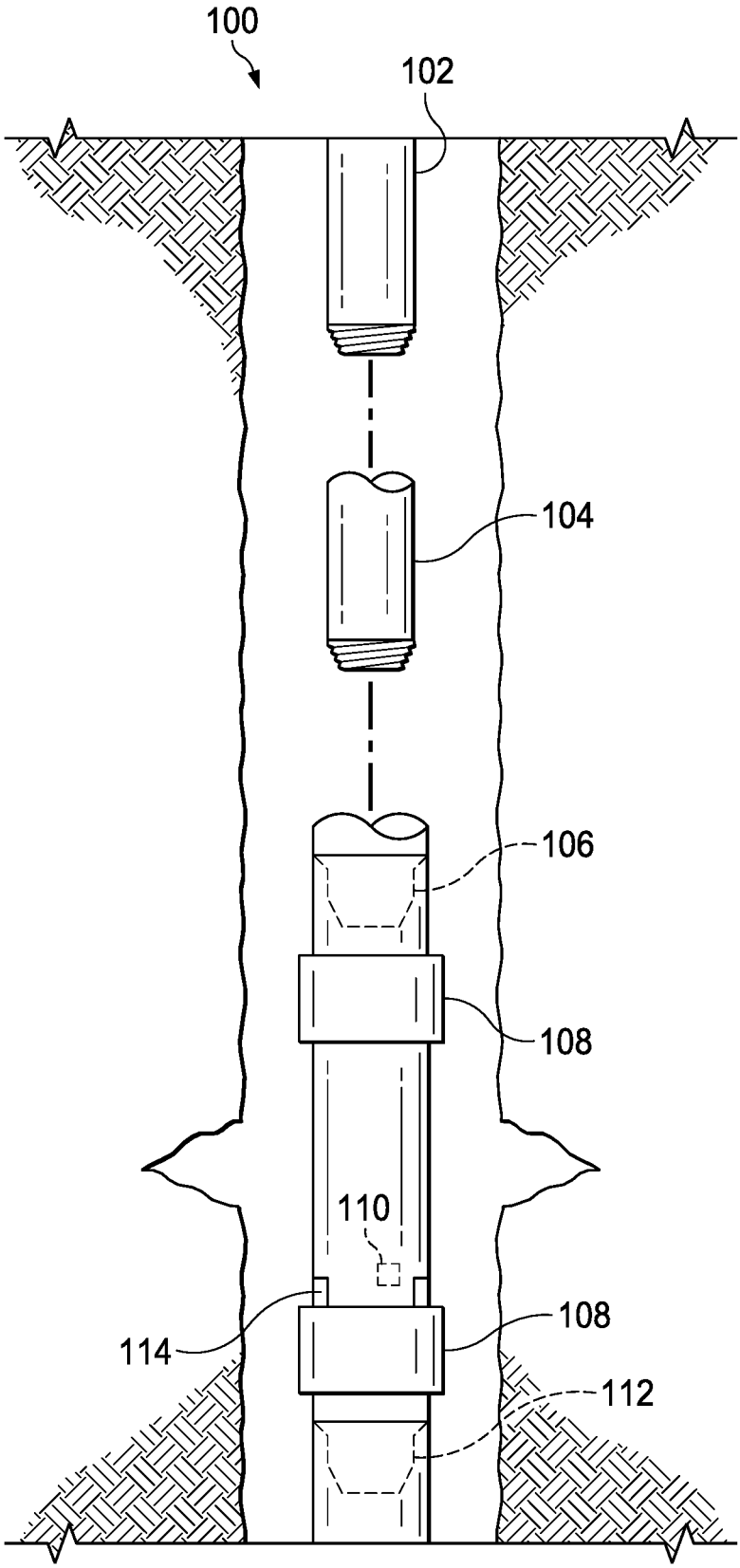
FIG. 1 is a side elevation drawing of an example of a configuration of running in hole (RIH) un-inflated drillable isolation packers, according to some implementations of the present disclosure.

The following detailed description describes techniques for optimizing the setting of a cement plug across total loss circulation zones (LCZs). For example, optimizing can refer to placement of the cement plug that results in hydrostatic head losses remaining within a predefined range. The techniques can be used to activate isolation packers, expose circulation ports, and disengage the tool. For example, the LCZ can be isolated above and below the loss zone with two drillable isolation packers, and a pump cement slurry can be circulated across the LCZ until a pressure lock is achieved. Various modifications, alterations, and permutations of the disclosed implementations can be made and will be readily apparent to those of ordinary skill in the art, and the general principles defined may be applied to other implementations and applications, without departing from scope of the disclosure. In some instances, details unnecessary to obtain an understanding of the described subject matter may be omitted so as to not obscure one or more described implementations with unnecessary detail and inasmuch as such details are within the skill of one of ordinary skill in the art. The present disclosure is not intended to be limited to the described or illustrated implementations, but to be accorded the widest scope consistent with the described principles and features.

Optimizing the setting of a cement plug across total loss circulation zones (LCZs) can provide the following results. The accuracy of the cementing operations can be increased to increase the chances of success to cure the losses. Risks can be mitigated, including risks associated with hole problems while running in hole (RIH), or pulling of the hole (POOH), with the cement stinger. Although primarily targeting loss circulation scenarios, the techniques of the present disclosure can provide an alternate solution to set cement plugs for wellbore isolation, plug & abandon (P&A), and kick-off plugs for sidetracks.

Table 1 summarizes some of the distinctions that the techniques of the present disclosure possess, as compared to cased hole stage cementing, for example.

TABLE 1

Features of Cementing Across LCZs Using Smart Drillable Cement Stinger

| Present Disclosure | Cased Hole Stage Cementing |
|---|---|
| Used for cement placement efficiency in loss circulation zones. | Used only for cased hole stage cementing. Cannot be used to remedy a loss circulation zone (LCZ) and restore full circulation to a well. |
| Can be utilized for open and cased hole operations. | For cased hole applications. |
| Can be used for main wellbore operations. The wellbore can be drilled out, and access to the main bore restored with full fluid circulation returns. The techniques may be applicable for remedying casing leaks as a mechanism for placing sealants in a precision type operation. | Used for only behind the casing cementing operations. A casing string must be run in the hole, allowing for casing-to-casing annulus cementing operations. |
| Consists of two drillable isolation packers for zonal isolation (top and bottom). If dealing with multiple LCZs, several isolation packers can be configured to straddle the LCZs. | Has only one packer which forms a base for the single stage cementing operations. |
| Includes drillable cement stingers (made preferably from fiberglass materials). The stingers provide additional flow path for the cement slurry to be placed efficiently in the intended target zones. | Requires cement to be pumped through the full internal diameter of the casing string into the annulus, and a top plug dropped to wipe afterwards. |
| Includes a methodology to shift open/close sliding sleeves, circulation/diversion ports, and stinger flow paths (for multiple LCZs isolation). Utilizes radio frequency identification (RFID) technology and ball drop of different sizes to activate various mechanisms. | Utilizes a two-plug system to open and close circulation ports. |
| Incorporates a safety release mechanism that allows the work string to be disengaged at the end of the operation, or in an emergency situation to avoid flash setting of cement. The release system works using RFID, ball drop, or use of a pipe wiper dart which locks in place, and allows pressuring up of the string to release and pull out of hole. | Does not have an emergency release feature. If the DV tool fails, for example, the circulation ports are blocked. In this case, the entire casing string will be filled with flash set cement which can be an expensive remedial operation. |

FIGS. 1-4 show different configurations over a sequence of events using techniques for optimizing the setting of a cement plug across total LCZs. The figures are briefly described individually, and then described as a group with respect to processes and configurations.

FIG. 1 is a side elevation drawing of an example of a configuration 100 of RIH un-inflated drillable isolation packers, according to some implementations of the present disclosure. The configuration 100 includes a drill pipe 102 to the surface, a safety joint 104, a drillable stringer 106, and uninflated packers 108. The configuration 100 further includes an RFID receiver 110, a ball catcher device 112, and a sliding sleeve or circulation part 114.

Figure 2:
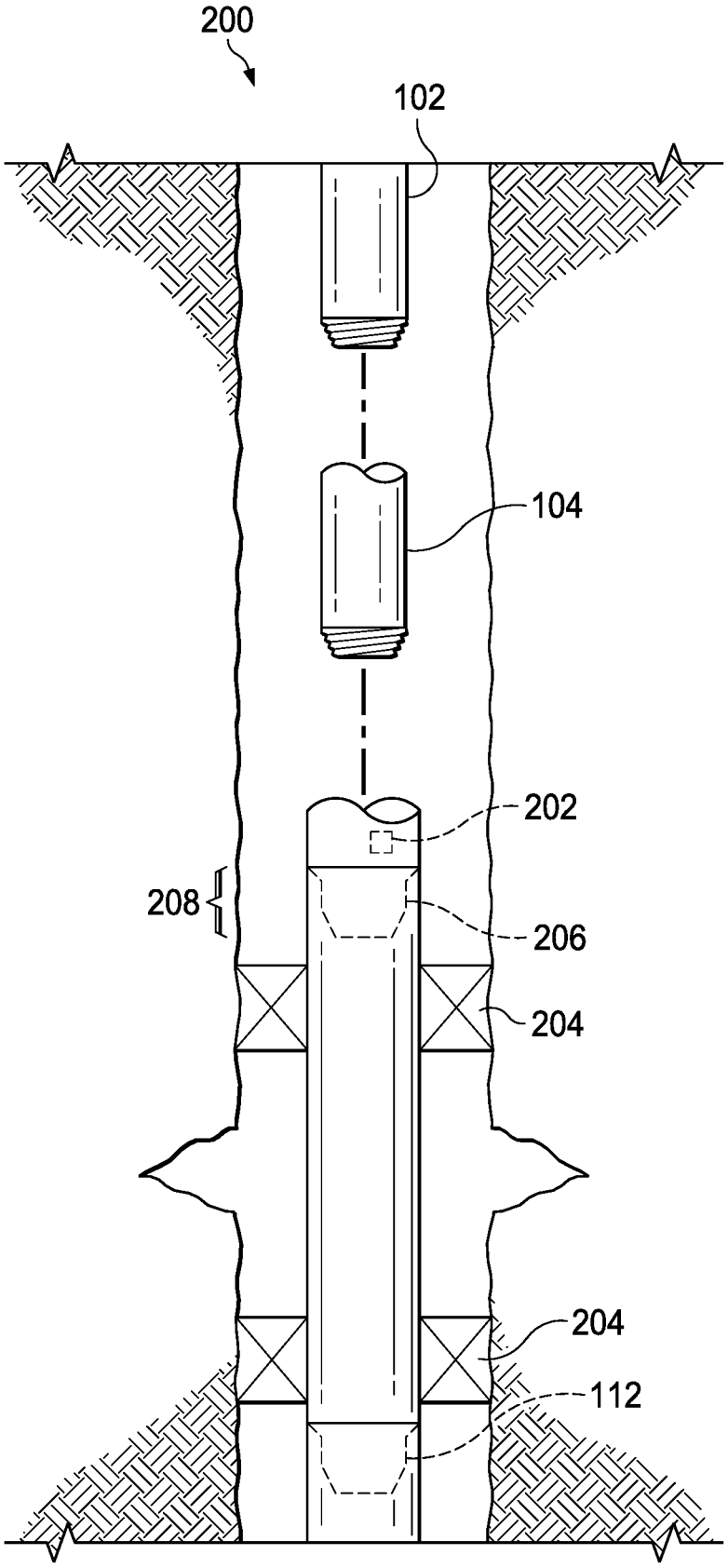
FIG. 2 is a side elevation drawing of an example of a configuration of drillable isolation packers inflated at depth, according to some implementations of the present disclosure.

FIG. 2 is a side elevation drawing of an example of a configuration 200 of drillable isolation packers inflated at depth, according to some implementations of the present disclosure. The configuration 200 shows an RFID capable release mechanism 202, inflated packers 204, and a profile 206 (for a wiper plug or wiper dart to release the stinger). At 208, a ball is sent (a catcher releases the stinger from the work string).

Figure 3:
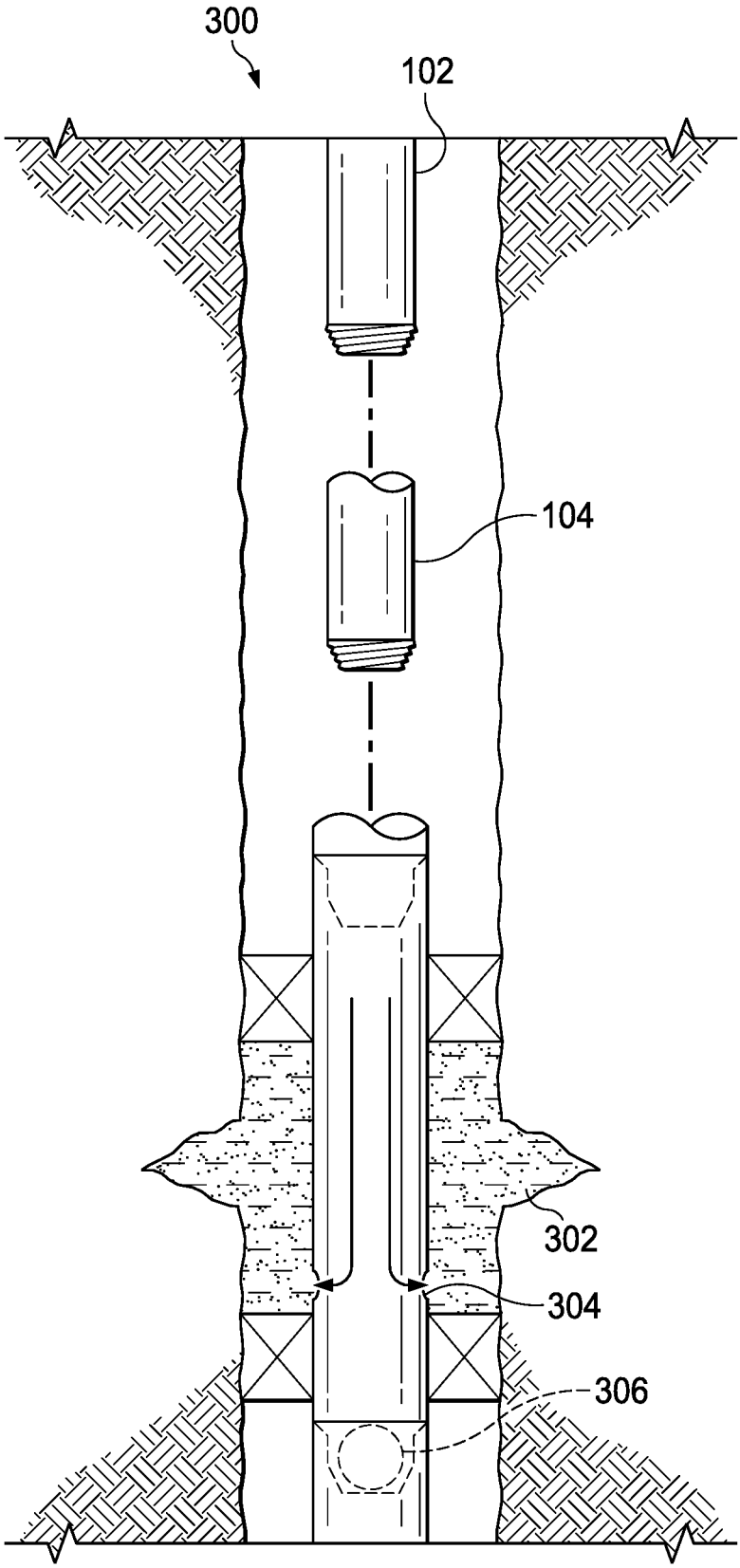
FIG. 3 is a side elevation drawing of an example of a configuration with circulation parts opened and a cement slurry pumped across a loss circulation zone, according to some implementations of the present disclosure.

FIG. 3 is a side elevation drawing of an example of a configuration 300 with circulation parts opened and a cement slurry pumped across a loss circulation zone, according to some implementations of the present disclosure. At 302, a cement slurry is pumped in place across the LCZ. At 304, circulation ports are activated open using an RFID or ball drop system. At 306, the ball is dropped in to activate the siding sleeve.

Figure 4:
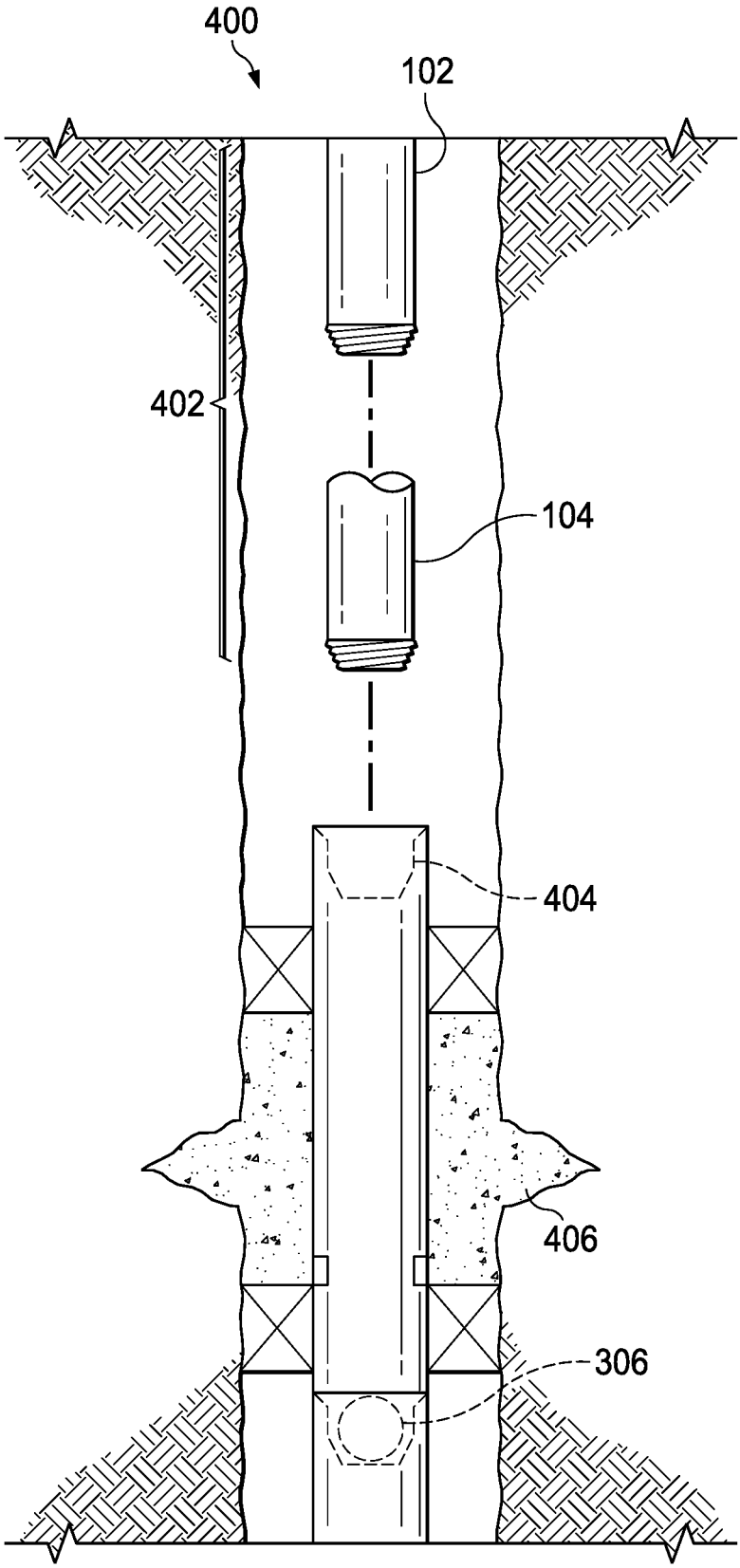
FIG. 4 is a side elevation drawing of an example of a configuration for cementing in place, according to some implementations of the present disclosure.

FIG. 4 is a side elevation drawing of an example of a configuration 400 for cementing in place, according to some implementations of the present disclosure. The drill pipe work string is disengaged from the stringer. The drillable stringer and the isolation packers can be drilled using a dedicated cleanout bottom hole assembly (BHA). At 402, a release of the work string occurs using RFID or ball drop technology. At 404, a wiper dart or wiper plug is pumped in place to disengage the work string from the stringer. At 406, cementing occurs in place.

Configuration

In some implementations, the configuration of a smart activated drillable cementing stinger, as described in the present disclosure and depicted in FIGS. 1-4, can include the following components and features.

First, two drillable isolation packers can be spaced out across the LCZ. For example, one packer can be below, and one packer above, the loss zone.

Second, for multiple LCZs and cement plugs, more than two drillable isolation packers can be required. For example, a pair of packers can straddle each LCZ, and be set against competent/in-gauge sections of the hole.

Third, a drillable stinger exists between each set of isolation packers. The drillable stinger can be made of fiberglass or a different material that has sufficient material strength to withstand the service loads envisaged.

Fourth, the drillable stinger can include a system to divert the flow of cement slurry to the target LCZ. The system can utilize sliding sleeves or circulation ports.

Fifth, a methodology is provided to shift open (or close) sliding sleeves, open (or close) diversion ports, open (or close) stinger flow paths (to activate slurry diversion for multiple cement plug placement across multiple LCZs), and disengage the string after successful placement of cement plugs. Disengagement can use one of the following options: 1) radio frequency operated drive systems, or 2) ball seats to accommodate various sized balls as required to activate various mechanisms of the system.

Sixth, a safety release mechanism can be used. The safety release mechanism can be required, for example, in the event of flash setting of the cement slurry.

Method of Deployment and Operation

In some implementations, the method of deployment and operation of a smart activated drillable cementing stinger, as described in the present disclosure and depicted in FIGS. 1-4, can include the following components and features.

First, the isolation packers can be deployed un-inflated, and the stinger can be run in the closed position to the desired depth to allow string circulation.

Second, at a target depth, the isolation packers can be inflated and set in place using a radio frequency identification (RFID) device or ball-drop technology.

Third, with the isolation packers set in place, the activities associated with shifting open and closing siding sleeves can be achieved as follows. For RFID activation, the activation tag can transmit an encoded instruction to the receiver downhole. Once received, the drive system or shaft can close the main stinger flow path. This can expose the slurry diversion path by shifting the sliding sleeves or circulation ports to the open position. The action of shifting the sliding sleeve, or circulation ports, can simultaneously close the main stinger flow path. For ball drop activation, several ball catchers for various sized activation balls can be used. Based on a sequence (and which section of the tool is to be activated), the right sized ball will be dropped to carry out the shifting open and closing actions.

Fourth, after exposing the diversion flow path, the cement slurry of a known design volume can be pumped into, and across, the LCZ as required. This can continue until a pressure lock-up is achieved. Upon completion of cement slurry pumping operations, the sliding sleeve or circulation port can be closed using the same mechanism of either RFID or ball-drop.

Fifth, upon completion of the cement plug operations, the string can be disengaged from the fiberglass or drillable cement stinger either using RFID or ball-drop technology. In some implementations, a third alternative includes using a wiper dart or wiper plug pumped into a pre-designed seat located at the top of the tool. Once located in the wiper dart seat, progressive or gradual pressure can be increased up to a pre-determined shearing pressure activates a string release. The dart and the rest of the singer can be left in place to be milled at a later time using a dedicated BHA.

Sixth, the tool and methodology can be used, for example, to set isolation, plug & abandon (P&A), and kick-off plugs for sidetracks.

Procedure

In some implementations, a procedure used for the smart activated drillable cementing stinger, as described in the present disclosure and depicted in FIGS. 1-4, can include the following components and features.

First, as shown in FIG. 1, an RIH drillable cement stinger includes two drillable isolation packers that are in the un-inflated position. A safety joint is included between the drillable stinger and the drill pipe to the desired depth. The two drillable isolation packers can be spaced out based on the LCZ, and cement volume requirements. The top drillable isolation packer can help to isolate the hydrostatic head above the losses zone, increasing the chances of curing the mud losses. The bottom drillable isolation packer can form a base on which the cement slurry is placed. The bottom drillable isolation packer can be rated or calibrated to a known differential pressure limit. The top and bottom drillable isolation packers can isolate the LCZ for efficient cement slurry (or other thixotropic fluid) placement to cure the losses.

Second, when the string is at the desired depth and the LCZ is between the two drillable isolation packers, the packers can be activated using RFID tags or ball-drop displaced with a fluid. Each of the options (RFID or ball-drop technology) can be used as a contingency to the other, such as in a redundant system.

Third, circulation or diversion path-ways used to pump the cement slurry can be opened.

Fourth, with the circulation ports opened, cement can be pumped across the loss zone and displaced with drilling fluid as per plan, or until a pressure lock-up is observed.

Fifth, upon completion of pumping and displacement operations, the string can be flushed. For example, flushing can be done using a volume of specific spacer sufficient to push the top of cement at least, for example, 10-20 feet below the top of the drillable fiber glass cement stinger. An RFID tag encoded with specific instructions to disengage the drillable stinger from the safety joint can be pumped concurrently. If ball-drop technology is to be utilized, the ball will similarly be pumped concurrently with the spacer. If using the ball-drop option, a ball seat or catcher can be installed below the disengaging mechanism such that when the ball lands in the ball seat, progressive increase of pressure will activate the shearing or disengagement of the string from the drillable stinger. A third option can include the use of a wiper dart or plug.

Sixth, in case the cement flash sets, the work string can be disconnected from the cement stinger by applying a certain magnitude of over-pull force on a safety joint located between the drill pipe and the drillable stinger.

Figure 5:
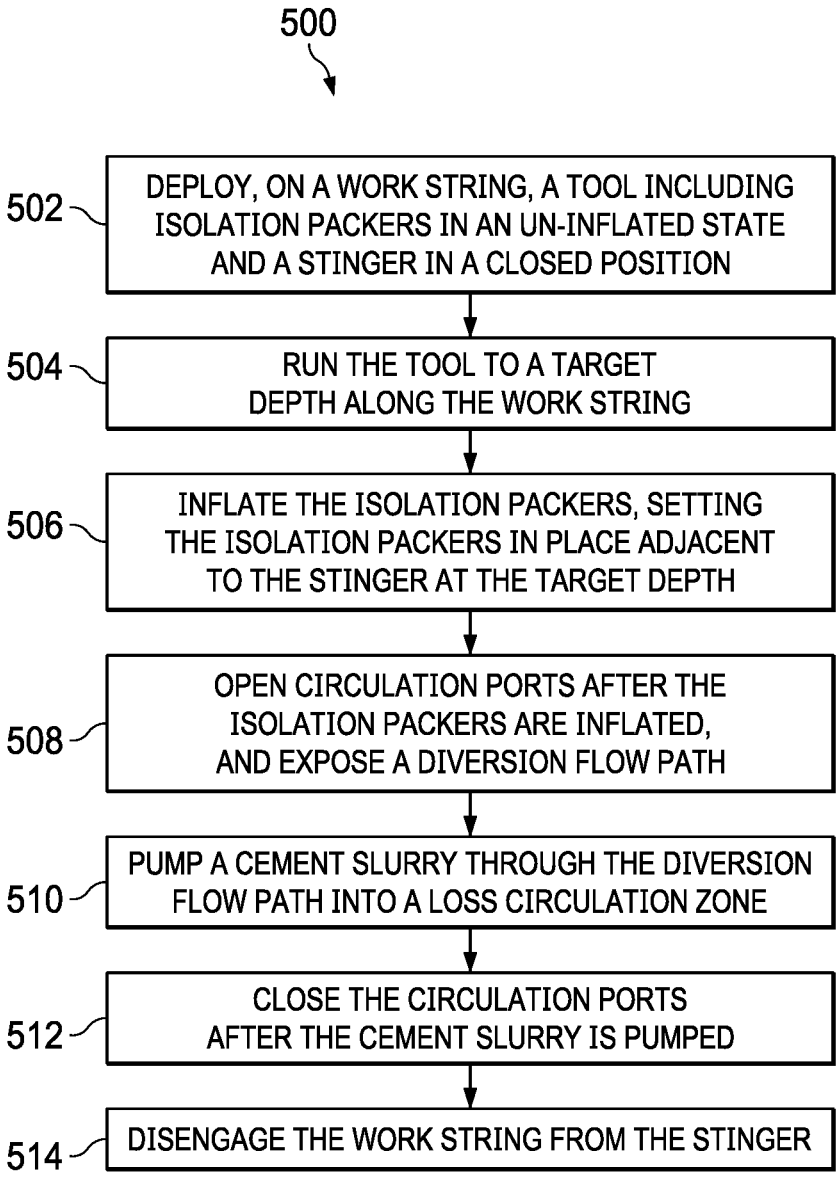
FIG. 5 is a flowchart of an example of a method for optimizing the setting of a cement plug across total loss circulation zones (LCZs), according to some implementations of the present disclosure.

FIG. 5 is a flowchart of an example of a method 500 for optimizing the setting of a cement plug across total loss circulation zones (LCZs), according to some implementations of the present disclosure. For clarity of presentation, the description that follows generally describes method 500 in the context of the other figures in this description. However, it will be understood that method 500 can be performed, for example, by any suitable system, environment, software, and hardware, or a combination of systems, environments, software, and hardware, as appropriate. In some implementations, various steps of method 500 can be run in parallel, in combination, in loops, or in any order.

At 502, a tool is deployed on a work string. The tool includes isolation packers in an un-inflated state and a stinger in a closed position. For example, FIG. 1 shows a tool that can be deployed. From 502, method 500 proceeds to 504.

At 504, the tool is run to a target depth along the work string. The target depth can be programmed at the surface, for example. For example, programming can be part of a user interface used on the surface for planning, controlling, and monitoring the process of cementing across loss circulation zones (LCZs) in the well. From 504, method 500 proceeds to 506.

At 506, the isolation packers are inflated, setting the isolation packers in place adjacent to the stinger at the target depth. For example, setting the isolation packers in place can include using a radio frequency identification (RFID) device or ball-drop technology. From 506, method 500 proceeds to 508.

At 508, circulation ports are opened after the isolation packers are inflated, exposing a diversion flow path. As an example, opening the circulation ports can include shifting the circulation ports open and closed using RFID activation. An encoded instruction can be transmitted using an activation tag to a downhole receiver to close, by a drive system or shaft, a main stinger flow path. The diversion flow path can be exposed by shifting the circulation ports to an open position. A flow path of the work string can be simultaneously closed through the shifting of the circulation ports. In some implementations, shifting the circulation ports open and closed can include using ball-drop activation. For example, a ball size can be selected from different sizes of activation balls. The ball size can be selected based on a sequence and which section relative to the tool is to be activated. A ball of the selected ball size can be dropped from a ball catcher. From 508, method 500 proceeds to 510.

At 510, a cement slurry is pumped through the diversion flow path into a loss circulation zone. For example, pumping the cement slurry can include pumping the cement slurry until a pressure lock-up is achieved closing the circulation ports using an RFID device or ball-drop technology. From 510, method 500 proceeds to 512.

At 512, the circulation ports are closed after the cement slurry is pumped. For example, referring to FIG. 3, circulation ports can be activated open using an RFID or ball drop system. From 512, method 500 proceeds to 514.

At 514, the work string is disengaged from the stinger. As an example, disengaging the work string from the stinger can include using RFID or ball-drop technology. In another example, disengaging the work string from the stinger can include pumping a wiper dart or a wiper plug into a pre-designed seat located at a top of the tool. A progressive and gradual pressure increase can be provided to create a shearing pressure to activate a release of the work string. After 514, method 500 can stop.

Figure 6:
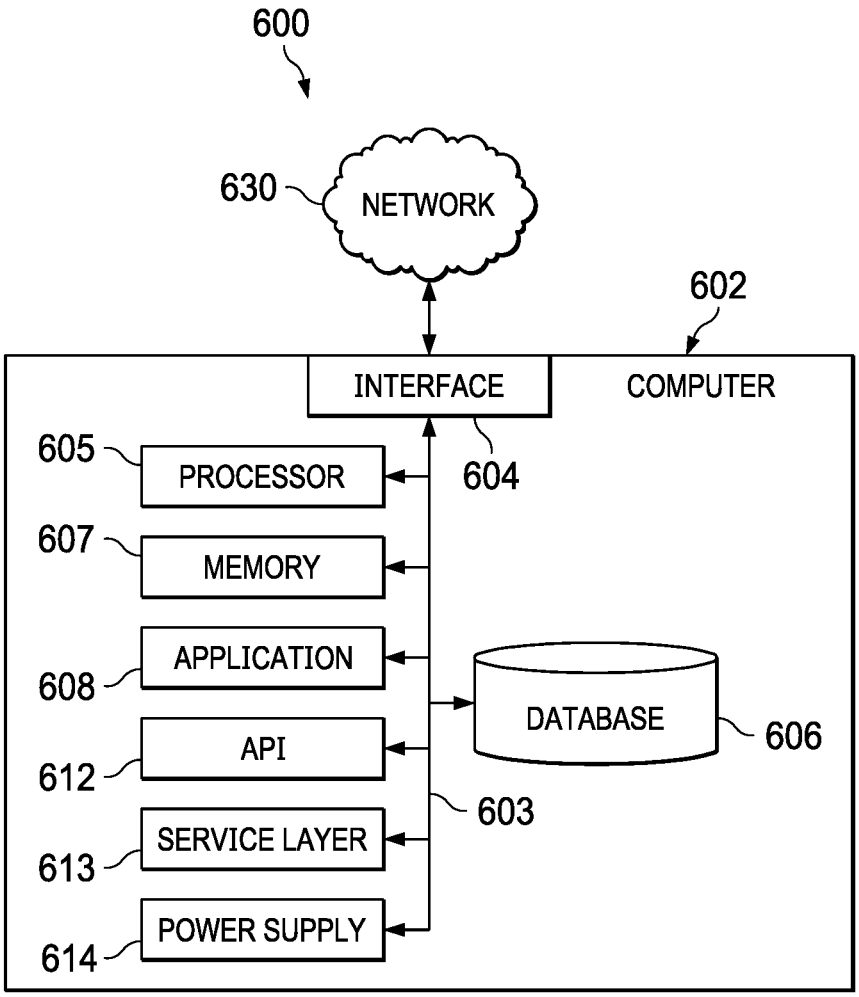
FIG. 6 is a block diagram illustrating an example computer system used to provide computational functionalities associated with described algorithms, methods, functions, processes, flows, and procedures as described in the present disclosure, according to some implementations of the present disclosure.

FIG. 6 is a block diagram of an example computer system 600 used to provide computational functionalities associated with described algorithms, methods, functions, processes, flows, and procedures described in the present disclosure, according to some implementations of the present disclosure. The illustrated computer 602 is intended to encompass any computing device such as a server, a desktop computer, a laptop/notebook computer, a wireless data port, a smart phone, a personal data assistant (PDA), a tablet computing device, or one or more processors within these devices, including physical instances, virtual instances, or both. The computer 602 can include input devices such as keypads, keyboards, and touch screens that can accept user information. Also, the computer 602 can include output devices that can convey information associated with the operation of the computer 602. The information can include digital data, visual data, audio information, or a combination of information. The information can be presented in a graphical user interface (UI) (or GUI).

The computer 602 can serve in a role as a client, a network component, a server, a database, a persistency, or components of a computer system for performing the subject matter described in the present disclosure. The illustrated computer 602 is communicably coupled with a network 630. In some implementations, one or more components of the computer 602 can be configured to operate within different environments, including cloud-computing-based environments, local environments, global environments, and combinations of environments.

At a top level, the computer 602 is an electronic computing device operable to receive, transmit, process, store, and manage data and information associated with the described subject matter. According to some implementations, the computer 602 can also include, or be communicably coupled with, an application server, an email server, a web server, a caching server, a streaming data server, or a combination of servers.

The computer 602 can receive requests over network 630 from a client application (for example, executing on another computer 602). The computer 602 can respond to the received requests by processing the received requests using software applications. Requests can also be sent to the computer 602 from internal users (for example, from a command console), external (or third) parties, automated applications, entities, individuals, systems, and computers.

Each of the components of the computer 602 can communicate using a system bus 603. In some implementations, any or all of the components of the computer 602, including hardware or software components, can interface with each other or the interface 604 (or a combination of both) over the system bus 603. Interfaces can use an application programming interface (API) 612, a service layer 613, or a combination of the API 612 and service layer 613. The API 612 can include specifications for routines, data structures, and object classes. The API 612 can be either computer-language independent or dependent. The API 612 can refer to a complete interface, a single function, or a set of APIs.

The service layer 613 can provide software services to the computer 602 and other components (whether illustrated or not) that are communicably coupled to the computer 602. The functionality of the computer 602 can be accessible for all service consumers using this service layer. Software services, such as those provided by the service layer 613, can provide reusable, defined functionalities through a defined interface. For example, the interface can be software written in JAVA, C++, or a language providing data in extensible markup language (XML) format. While illustrated as an integrated component of the computer 602, in alternative implementations, the API 612 or the service layer 613 can be stand-alone components in relation to other components of the computer 602 and other components communicably coupled to the computer 602. Moreover, any or all parts of the API 612 or the service layer 613 can be implemented as child or sub-modules of another software module, enterprise application, or hardware module without departing from the scope of the present disclosure.

The computer 602 includes an interface 604. Although illustrated as a single interface 604 in FIG. 6, two or more interfaces 604 can be used according to particular needs, desires, or particular implementations of the computer 602 and the described functionality. The interface 604 can be used by the computer 602 for communicating with other systems that are connected to the network 630 (whether illustrated or not) in a distributed environment. Generally, the interface 604 can include, or be implemented using, logic encoded in software or hardware (or a combination of software and hardware) operable to communicate with the network 630. More specifically, the interface 604 can include software supporting one or more communication protocols associated with communications. As such, the network 630 or the interface's hardware can be operable to communicate physical signals within and outside of the illustrated computer 602.

The computer 602 includes a processor 605. Although illustrated as a single processor 605 in FIG. 6, two or more processors 605 can be used according to particular needs, desires, or particular implementations of the computer 602 and the described functionality. Generally, the processor 605 can execute instructions and can manipulate data to perform the operations of the computer 602, including operations using algorithms, methods, functions, processes, flows, and procedures as described in the present disclosure.

The computer 602 also includes a database 606 that can hold data for the computer 602 and other components connected to the network 630 (whether illustrated or not). For example, database 606 can be an in-memory, conventional, or a database storing data consistent with the present disclosure. In some implementations, database 606 can be a combination of two or more different database types (for example, hybrid in-memory and conventional databases) according to particular needs, desires, or particular implementations of the computer 602 and the described functionality. Although illustrated as a single database 606 in FIG. 6, two or more databases (of the same, different, or combination of types) can be used according to particular needs, desires, or particular implementations of the computer 602 and the described functionality. While database 606 is illustrated as an internal component of the computer 602, in alternative implementations, database 606 can be external to the computer 602.

The computer 602 also includes a memory 607 that can hold data for the computer 602 or a combination of components connected to the network 630 (whether illustrated or not). Memory 607 can store any data consistent with the present disclosure. In some implementations, memory 607 can be a combination of two or more different types of memory (for example, a combination of semiconductor and magnetic storage) according to particular needs, desires, or particular implementations of the computer 602 and the described functionality. Although illustrated as a single memory 607 in FIG. 6, two or more memories 607 (of the same, different, or combination of types) can be used according to particular needs, desires, or particular implementations of the computer 602 and the described functionality. While memory 607 is illustrated as an internal component of the computer 602, in alternative implementations, memory 607 can be external to the computer 602.

The application 608 can be an algorithmic software engine providing functionality according to particular needs, desires, or particular implementations of the computer 602 and the described functionality. For example, application 608 can serve as one or more components, modules, or applications. Further, although illustrated as a single application 608, the application 608 can be implemented as multiple applications 608 on the computer 602. In addition, although illustrated as internal to the computer 602, in alternative implementations, the application 608 can be external to the computer 602.

The computer 602 can also include a power supply 614. The power supply 614 can include a rechargeable or non-rechargeable battery that can be configured to be either user- or non-user-replaceable. In some implementations, the power supply 614 can include power-conversion and management circuits, including recharging, standby, and power management functionalities. In some implementations, the power-supply 614 can include a power plug to allow the computer 602 to be plugged into a wall socket or a power source to, for example, power the computer 602 or recharge a rechargeable battery.

There can be any number of computers 602 associated with, or external to, a computer system containing computer 602, with each computer 602 communicating over network 630. Further, the terms "client," "user," and other appropriate terminology can be used interchangeably, as appropriate, without departing from the scope of the present disclosure. Moreover, the present disclosure contemplates that many users can use one computer 602 and one user can use multiple computers 602.

Described implementations of the subject matter can include one or more features, alone or in combination.

For example, in a first implementation, a computer-implemented method includes the following. A tool is deployed on a work string. The tool includes isolation packers in an un-inflated state and a stinger in a closed position. The tool is run to a target depth along the work string. The isolation packers are inflated, setting the isolation packers in place adjacent to the stinger at the target depth. Circulation ports are opened after the isolation packers are inflated, exposing a diversion flow path. A cement slurry is pumped through the diversion flow path into a loss circulation zone. The circulation ports are closed after the cement slurry is pumped. The work string is disengaged from the stinger.

The foregoing and other described implementations can each, optionally, include one or more of the following features:

A first feature, combinable with any of the following features, where setting the isolation packers in place includes using a radio frequency identification (RFID) device or ball-drop technology.

A second feature, combinable with any of the previous or following features, where opening the circulation ports includes shifting the circulation ports open and closed using RFID activation, including: transmitting, using an activation tag, an encoded instruction to a downhole receiver to close, by a drive system or shaft, a main stinger flow path; exposing the diversion flow path by shifting the circulation ports to an open position; and simultaneously closing a flow path of the work string through the shifting of the circulation ports.

A third feature, combinable with any of the previous or following features, where shifting the circulation ports open and closed includes using ball-drop activation comprising: selecting a ball size from different sizes of activation balls, where the ball size is selected based on a sequence and which section relative to the tool is to be activated; and dropping, from a ball catcher, a ball of the ball size.

A fourth feature, combinable with any of the previous or following features, where pumping the cement slurry includes pumping the cement slurry until a pressure lock-up is achieved and closing the circulation ports using an RFID device or ball-drop technology.

A fifth feature, combinable with any of the previous or following features, where disengaging the work string from the stinger includes using RFID or ball-drop technology.

A sixth feature, combinable with any of the previous or following features, where disengaging the work string from the stinger includes: pumping a wiper dart or a wiper plug into a pre-designed seat located at a top of the tool; and proving a progressive and gradual pressure increase to create a shearing pressure to activate a release of the work string.

In a second implementation, a non-transitory, computer-readable medium stores one or more instructions executable by a computer system to perform operations including the following. A tool is deployed on a work string. The tool includes isolation packers in an un-inflated state and a stinger in a closed position. The tool is run to a target depth along the work string. The isolation packers are inflated, setting the isolation packers in place adjacent to the stinger at the target depth. Circulation ports are opened after the isolation packers are inflated, exposing a diversion flow path. A cement slurry is pumped through the diversion flow path into a loss circulation zone. The circulation ports are closed after the cement slurry is pumped. The work string is disengaged from the stinger.

The foregoing and other described implementations can each, optionally, include one or more of the following features:

A first feature, combinable with any of the following features, where setting the isolation packers in place includes using a radio frequency identification (RFID) device or ball-drop technology.

A second feature, combinable with any of the previous or following features, where opening the circulation ports includes shifting the circulation ports open and closed using RFID activation, including: transmitting, using an activation tag, an encoded instruction to a downhole receiver to close, by a drive system or shaft, a main stinger flow path; exposing the diversion flow path by shifting the circulation ports to an open position; and simultaneously closing a flow path of the work string through the shifting of the circulation ports.

A third feature, combinable with any of the previous or following features, where shifting the circulation ports open and closed includes using ball-drop activation comprising: selecting a ball size from different sizes of activation balls, where the ball size is selected based on a sequence and which section relative to the tool is to be activated; and dropping, from a ball catcher, a ball of the ball size.

A fourth feature, combinable with any of the previous or following features, where pumping the cement slurry includes pumping the cement slurry until a pressure lock-up is achieved and closing the circulation ports using an RFID device or ball-drop technology.

A fifth feature, combinable with any of the previous or following features, where disengaging the work string from the stinger includes using RFID or ball-drop technology.

A sixth feature, combinable with any of the previous or following features, where disengaging the work string from the stinger includes: pumping a wiper dart or a wiper plug into a pre-designed seat located at a top of the tool; and proving a progressive and gradual pressure increase to create a shearing pressure to activate a release of the work string.

In a third implementation, a computer-implemented system includes one or more processors and a non-transitory computer-readable storage medium coupled to the one or more processors and storing programming instructions for execution by the one or more processors. The programming instructions instruct the one or more processors to perform operations including the following. A tool is deployed on a work string. The tool includes isolation packers in an un-inflated state and a stinger in a closed position. The tool is run to a target depth along the work string. The isolation packers are inflated, setting the isolation packers in place adjacent to the stinger at the target depth. Circulation ports are opened after the isolation packers are inflated, exposing a diversion flow path. A cement slurry is pumped through the diversion flow path into a loss circulation zone. The circulation ports are closed after the cement slurry is pumped. The work string is disengaged from the stinger.

The foregoing and other described implementations can each, optionally, include one or more of the following features:

A first feature, combinable with any of the following features, where setting the isolation packers in place includes using a radio frequency identification (RFID) device or ball-drop technology.

A second feature, combinable with any of the previous or following features, where opening the circulation ports includes shifting the circulation ports open and closed using RFID activation, including: transmitting, using an activation tag, an encoded instruction to a downhole receiver to close, by a drive system or shaft, a main stinger flow path; exposing the diversion flow path by shifting the circulation ports to an open position; and simultaneously closing a flow path of the work string through the shifting of the circulation ports.

A third feature, combinable with any of the previous or following features, where shifting the circulation ports open and closed includes using ball-drop activation comprising: selecting a ball size from different sizes of activation balls, where the ball size is selected based on a sequence and which section relative to the tool is to be activated; and dropping, from a ball catcher, a ball of the ball size.

A fourth feature, combinable with any of the previous or following features, where pumping the cement slurry includes pumping the cement slurry until a pressure lock-up is achieved and closing the circulation ports using an RFID device or ball-drop technology.

A fifth feature, combinable with any of the previous or following features, where disengaging the work string from the stinger includes using RFID or ball-drop technology.

Implementations of the subject matter and the functional operations described in this specification can be implemented in digital electronic circuitry, in tangibly embodied computer software or firmware, in computer hardware, including the structures disclosed in this specification and their structural equivalents, or in combinations of one or more of them. Software implementations of the described subject matter can be implemented as one or more computer programs. Each computer program can include one or more modules of computer program instructions encoded on a tangible, non-transitory, computer-readable computer-storage medium for execution by, or to control the operation of, data processing apparatus. Alternatively, or additionally, the program instructions can be encoded in/on an artificially generated propagated signal. For example, the signal can be a machine-generated electrical, optical, or electromagnetic signal that is generated to encode information for transmission to a suitable receiver apparatus for execution by a data processing apparatus. The computer-storage medium can be a machine-readable storage device, a machine-readable storage substrate, a random or serial access memory device, or a combination of computer-storage mediums.

The terms "data processing apparatus," "computer," and "electronic computer device" (or equivalent as understood by one of ordinary skill in the art) refer to data processing hardware. For example, a data processing apparatus can encompass all kinds of apparatuses, devices, and machines for processing data, including by way of example, a programmable processor, a computer, or multiple processors or computers. The apparatus can also include special purpose logic circuitry including, for example, a central processing unit (CPU), a field-programmable gate array (FPGA), or an application-specific integrated circuit (ASIC). In some implementations, the data processing apparatus or special purpose logic circuitry (or a combination of the data processing apparatus or special purpose logic circuitry) can be hardware- or software-based (or a combination of both hardware- and software-based). The apparatus can optionally include code that creates an execution environment for computer programs, for example, code that constitutes processor firmware, a protocol stack, a database management system, an operating system, or a combination of execution environments. The present disclosure contemplates the use of data processing apparatuses with or without conventional operating systems, such as LINUX, UNIX, WINDOWS, MAC OS, ANDROID, or IOS.

A computer program, which can also be referred to or described as a program, software, a software application, a module, a software module, a script, or code, can be written in any form of programming language. Programming languages can include, for example, compiled languages, interpreted languages, declarative languages, or procedural languages. Programs can be deployed in any form, including as stand-alone programs, modules, components, subroutines, or units for use in a computing environment. A computer program can, but need not, correspond to a file in a file system. A program can be stored in a portion of a file that holds other programs or data, for example, one or more scripts stored in a markup language document, in a single file dedicated to the program in question, or in multiple coordinated files storing one or more modules, sub-programs, or portions of code. A computer program can be deployed for execution on one computer or on multiple computers that are located, for example, at one site or distributed across multiple sites that are interconnected by a communication network. While portions of the programs illustrated in the various figures may be shown as individual modules that implement the various features and functionality through various objects, methods, or processes, the programs can instead include a number of sub-modules, third-party services, components, and libraries. Conversely, the features and functionality of various components can be combined into single components as appropriate. Thresholds used to make computational determinations can be statically, dynamically, or both statically and dynamically determined.

The methods, processes, or logic flows described in this specification can be performed by one or more programmable computers executing one or more computer programs to perform functions by operating on input data and generating output. The methods, processes, or logic flows can also be performed by, and apparatus can also be implemented as, special purpose logic circuitry, for example, a CPU, an FPGA, or an ASIC.

Computers suitable for the execution of a computer program can be based on one or more of general and special purpose microprocessors and other kinds of CPUs. The elements of a computer are a CPU for performing or executing instructions and one or more memory devices for storing instructions and data. Generally, a CPU can receive instructions and data from (and write data to) a memory.

Graphics processing units (GPUs) can also be used in combination with CPUs. The GPUs can provide specialized processing that occurs in parallel to processing performed by CPUs. The specialized processing can include artificial intelligence (AI) applications and processing, for example. GPUs can be used in GPU clusters or in multi-GPU computing.

A computer can include, or be operatively coupled to, one or more mass storage devices for storing data. In some implementations, a computer can receive data from, and transfer data to, the mass storage devices including, for example, magnetic, magneto-optical disks, or optical disks. Moreover, a computer can be embedded in another device, for example, a mobile telephone, a personal digital assistant (PDA), a mobile audio or video player, a game console, a global positioning system (GPS) receiver, or a portable storage device such as a universal serial bus (USB) flash drive.

Computer-readable media (transitory or non-transitory, as appropriate) suitable for storing computer program instructions and data can include all forms of permanent/non-permanent and volatile/non-volatile memory, media, and memory devices. Computer-readable media can include, for example, semiconductor memory devices such as random access memory (RAM), read-only memory (ROM), phase change memory (PRAM), static random access memory (SRAM), dynamic random access memory (DRAM), erasable programmable read-only memory (EPROM), electrically erasable programmable read-only memory (EEPROM), and flash memory devices. Computer-readable media can also include, for example, magnetic devices such as tape, cartridges, cassettes, and internal/removable disks. Computer-readable media can also include magneto-optical disks and optical memory devices and technologies including, for example, digital video disc (DVD), CD-ROM, DVD+/−R, DVD-RAM, DVD-ROM, HD-DVD, and BLU-RAY. The memory can store various objects or data, including caches, classes, frameworks, applications, modules, backup data, jobs, web pages, web page templates, data structures, database tables, repositories, and dynamic information. Types of objects and data stored in memory can include parameters, variables, algorithms, instructions, rules, constraints, and references. Additionally, the memory can include logs, policies, security or access data, and reporting files. The processor and the memory can be supplemented by, or incorporated into, special purpose logic circuitry.

Implementations of the subject matter described in the present disclosure can be implemented on a computer having a display device for providing interaction with a user, including displaying information to (and receiving input from) the user. Types of display devices can include, for example, a cathode ray tube (CRT), a liquid crystal display (LCD), a light-emitting diode (LED), and a plasma monitor. Display devices can include a keyboard and pointing devices including, for example, a mouse, a trackball, or a trackpad.

User input can also be provided to the computer through the use of a touchscreen, such as a tablet computer surface with pressure sensitivity or a multi-touch screen using capacitive or electric sensing. Other kinds of devices can be used to provide for interaction with a user, including to receive user feedback including, for example, sensory feedback including visual feedback, auditory feedback, or tactile feedback. Input from the user can be received in the form of acoustic, speech, or tactile input. In addition, a computer can interact with a user by sending documents to, and receiving documents from, a device that the user uses. For example, the computer can send web pages to a web browser on a user's client device in response to requests received from the web browser.

The term "graphical user interface," or "GUI," can be used in the singular or the plural to describe one or more graphical user interfaces and each of the displays of a particular graphical user interface. Therefore, a GUI can represent any graphical user interface, including, but not limited to, a web browser, a touch-screen, or a command line interface (CLI) that processes information and efficiently presents the information results to the user. In general, a GUI can include a plurality of user interface (UI) elements, some or all associated with a web browser, such as interactive fields, pull-down lists, and buttons. These and other UI elements can be related to or represent the functions of the web browser.

Implementations of the subject matter described in this specification can be implemented in a computing system that includes a back-end component, for example, as a data server, or that includes a middleware component, for example, an application server. Moreover, the computing system can include a front-end component, for example, a client computer having one or both of a graphical user interface or a Web browser through which a user can interact with the computer. The components of the system can be interconnected by any form or medium of wireline or wireless digital data communication (or a combination of data communication) in a communication network. Examples of communication networks include a local area network (LAN), a radio access network (RAN), a metropolitan area network (MAN), a wide area network (WAN), Worldwide Interoperability for Microwave Access (WIMAX), a wireless local area network (WLAN) (for example, using 802.11 a/b/g/n or 802.20 or a combination of protocols), all or a portion of the Internet, or any other communication system or systems at one or more locations (or a combination of communication networks). The network can communicate with, for example, Internet Protocol (IP) packets, frame relay frames, asynchronous transfer mode (ATM) cells, voice, video, data, or a combination of communication types between network addresses.

The computing system can include clients and servers. A client and server can generally be remote from each other and can typically interact through a communication network. The relationship of client and server can arise by virtue of computer programs running on the respective computers and having a client-server relationship.

Cluster file systems can be any file system type accessible from multiple servers for read and update. Locking or consistency tracking may not be necessary since the locking of exchange file system can be done at application layer. Furthermore, Unicode data files can be different from non-Unicode data files.

While this specification contains many specific implementation details, these should not be construed as limitations on the scope of what may be claimed, but rather as descriptions of features that may be specific to particular implementations. Certain features that are described in this specification in the context of separate implementations can also be implemented, in combination, in a single implementation. Conversely, various features that are described in the context of a single implementation can also be implemented in multiple implementations, separately, or in any suitable sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results. In certain circumstances, multitasking or parallel processing (or a combination of multitasking and parallel processing) may be advantageous and performed as deemed appropriate.

Moreover, the separation or integration of various system modules and components in the previously described implementations should not be understood as requiring such separation or integration in all implementations. It should be understood that the described program components and systems can generally be integrated together in a single software product or packaged into multiple software products.

Accordingly, the previously described example implementations do not define or constrain the present disclosure. Other changes, substitutions, and alterations are also possible without departing from the spirit and scope of the present disclosure.

Furthermore, any claimed implementation is considered to be applicable to at least a computer-implemented method; a non-transitory, computer-readable medium storing computer-readable instructions to perform the computer-implemented method; and a computer system including a computer memory interoperably coupled with a hardware processor configured to perform the computer-implemented method or the instructions stored on the non-transitory, computer-readable medium.

What is claimed is:

1. A non-transitory, computer-readable medium storing one or more instructions executable by a computer system to perform operations comprising:

deploying, on a work string, a tool including isolation packers in an un-inflated state and a stinger in a closed position;

programming, into the tool using a computer-implemented user interface of a computer at a surface, a target depth for the tool, the target depth being downhole of the surface;

running the tool to the target depth along the work string;

inflating the isolation packers, setting the isolation packers in place adjacent to the stinger at the target depth;

opening circulation ports after the isolation packers are inflated, and exposing a diversion flow path;

pumping a cement slurry through the diversion flow path into a loss circulation zone;

closing the circulation ports after the cement slurry is pumped; and disengaging the work string from the stinger.

2. The non-transitory, computer-readable medium of claim 1, wherein setting the isolation packers in place includes using a radio frequency identification (RFID) device or ball-drop technology.

3. The non-transitory, computer-readable medium of claim 1, wherein opening the circulation ports includes shifting the circulation ports open and closed using radio frequency identification (RFID) activation, comprising:

transmitting, using an activation tag, an encoded instruction to a downhole receiver to close, by a drive system or shaft, a main stinger flow path;

exposing the diversion flow path by shifting the circulation ports to an open position; and simultaneously closing a flow path of the work string through the shifting of the circulation ports.

4. The non-transitory, computer-readable medium of claim 3, wherein shifting the circulation ports open and closed includes using ball-drop activation comprising:

selecting a ball size from different sizes of activation balls, wherein the ball size is selected based on a sequence and which section relative to the tool is to be activated; and dropping, from a ball catcher, a ball of the ball size.

5. The non-transitory, computer-readable medium of claim 1, wherein pumping the cement slurry comprises:

pumping the cement slurry until a pressure lock-up is achieved; and closing the circulation ports using a radio frequency identification (RFID) device or ball-drop technology.

6. The non-transitory, computer-readable medium of claim 1, wherein disengaging the work string from the stinger includes using radio frequency identification (RFID) or ball-drop technology.

7. The non-transitory, computer-readable medium of claim 1, wherein disengaging the work string from the stinger includes:

pumping a wiper dart or a wiper plug into a pre-designed seat located at a top of the tool; and proving a progressive and gradual pressure increase to create a shearing pressure to activate a release of the work string.

8. A computer-implemented system, comprising:

one or more processors; and a non-transitory computer-readable storage medium coupled to the one or more processors and storing programming instructions for execution by the one or more processors, the programming instructions instructing the one or more processors to perform operations comprising:

deploying, on a work string, a tool including isolation packers in an un-inflated state and a stinger in a closed position;

programming, into the tool using a computer-implemented user interface of a computer at a surface, a target depth for the tool, the target depth being downhole of the surface;

running the tool to the target depth along the work string;

inflating the isolation packers, setting the isolation packers in place adjacent to the stinger at the target depth;

opening circulation ports after the isolation packers are inflated, and exposing a diversion flow path;

pumping a cement slurry through the diversion flow path into a loss circulation zone;

closing the circulation ports after the cement slurry is pumped; and disengaging the work string from the stinger.

9. The computer-implemented system of claim 8, wherein setting the isolation packers in place includes using a radio frequency identification (RFID) device or ball-drop technology.

10. The computer-implemented system of claim 8, wherein opening the circulation ports includes shifting the circulation ports open and closed using radio frequency identification (RFID) activation, comprising:

transmitting, using an activation tag, an encoded instruction to a downhole receiver to close, by a drive system or shaft, a main stinger flow path;

exposing the diversion flow path by shifting the circulation ports to an open position; and simultaneously closing a flow path of the work string through the shifting of the circulation ports.

11. The computer-implemented system of claim 10, wherein shifting the circulation ports open and closed includes using ball-drop activation comprising:

selecting a ball size from different sizes of activation balls, wherein the ball size is selected based on a sequence and which section relative to the tool is to be activated; and dropping, from a ball catcher, a ball of the ball size.

12. The computer-implemented system of claim 8, wherein pumping the cement slurry comprises:

pumping the cement slurry until a pressure lock-up is achieved; and closing the circulation ports using a radio frequency identification (RFID) device or ball-drop technology.

13. The computer-implemented system of claim 8, wherein disengaging the work string from the stinger includes using radio frequency identification (RFID) or ball-drop technology.

* * * * *